US005252033A

United States Patent [19]

Lin

[11] Patent Number: 5,252,033

[45] Date of Patent: Oct. 12, 1993

[54] PORTABLE CAR-USED OIL EXTRACTING AND TIRE INFLATION APPARATUS

[76] Inventor: Yin-Hsien Lin, 2Fl., No. 133, Ming Hsiang Street, Pan Ch'iao City, Taipei Hsien, Taiwan

[21] Appl. No.: 924,913

[22] Filed: Aug. 5, 1992

[51] Int. Cl.[5] ..... F04B 21/00; F16C 3/14

[52] U.S. Cl. ..... 417/234; 184/1.5

[58] Field of Search ..... 417/234, 521, 538; 184/1.5

[56] References Cited

U.S. PATENT DOCUMENTS

| | | | |
|---|---|---|---|
| 1,849,060 | 3/1932 | Dodson | 417/538 |
| 4,095,673 | 6/1978 | Takeuchi | 184/1.5 |
| 4,357,617 | 11/1982 | Shimazawa et al. | 417/521 |
| 4,453,898 | 6/1984 | Leka et al. | 417/521 |
| 4,787,827 | 11/1988 | Hinkle et al. | 417/234 |
| 5,002,154 | 3/1991 | Chen | 184/1.5 |
| 5,044,469 | 9/1991 | Liu | 184/1.5 |
| 5,051,068 | 9/1991 | Wong | 417/234 |
| 5,100,305 | 3/1992 | Zirps | 417/521 |
| 5,148,785 | 9/1992 | Sendak | 184/1.5 |

*Primary Examiner*—Richard A. Bertsch
*Assistant Examiner*—Alfred Basichas
*Attorney, Agent, or Firm*—Varndell Legal Group

[57] ABSTRACT

A portable car-used oil extracting and tire inflation apparatus, mainly comprising an electrical motor on the rotary shaft of which there are pivoted a crank shaft on the front end and a cooling fan on the rear end. A rocker arm is pivotably fixed to the crank shaft by which rocker arm the crank shaft can drive the coaxial pistons of the air and the oil cylinders to move forwards and backwards, forming an air and oil pump to perform oil extracting and tire inflation work.

5 Claims, 3 Drawing Sheets

PORTABLE CAR-USED OIL EXTRACTING AND TIRE INFLATION APPARATUS

FIELD OF THE INVENTION

The present invention relates to a car-used oil extracting and tire inflation apparatus, especially to an apparatus employing a single motor to drive synchronously the coaxial pistons of the air pump and the oil pump to perform oil extracting and tire inflation functions, facilitating changing motor oil, supplying oil, tire inflation, etc.

BACKGROUND OF THE INVENTION

Most of the car maintenance and repair work contain changing oil. Although oil extracting apparatuses have been on the market, they are of great bulk and only suitable for automobile repair shops. A lightweight and convenient type suitable for average consumers' use has not yet been available.

As for tire inflation apparatuses, there are two types on the market, the foot activating type and the electrical type. The former has almost been abandoned by people; the latter does not have the oil extracting function. Therefore, an apparatus capable of performing oil extracting and tire inflation is of unique value.

OBJECT OF THE INVENTION

The primary object of the present invention is to provide a portable car-used oil extracting and tire inflation apparatus that is specially designed to perform synchronously oil extracting by the oil pump and tire inflation by the air pump.

The other object of the present invention is to provide a portable lightweight car-used oil extracting and tire inflation apparatus employing an electrical motor to drive simultaneously the air pump and the oil pump for use.

The portable car-used oil extracting and tire inflation apparatus of this invention can accomplish the objects stated above and other advantages.

SUMMARY OF THE INVENTION

The present invention first employs an electrical motor driving a cooling fan mounted on the rear end of the motor shaft to dissipate heat on the other end of which motor shaft is pivoted a crank shaft. One end of a rocker arm is pivoted to the crank shaft by a pin; the other end of the rocker arm is connected to a cylinder shaft on the front end of which is mounted a graphite ring that is made of graphitic material. The graphitic piston ring can endure high temperature with no binding of the piston happening when it reciprocates in the oil cylinder that is made by the powder metallurgy method. Furthermore, a large piston is mounted on the rear end of the cylinder shaft and an oil seal is placed between the rear end of the oil cylinder and the air cylinder. The pumps constituted by two uniflow valves are each connected to the air and the oil cylinders to form an air pump and an oil pump that employ the same shaft so that the output of the electrical motor can perform air pumping and oil pumping functions in one apparatus.

A complete understanding of these and other features and advantages of the present invention will become apparent from a careful consideration of the following detailed description of a certain embodiment illustrated in the accompanying drawings.

DETAILED DESCRIPTION

Figure 1:
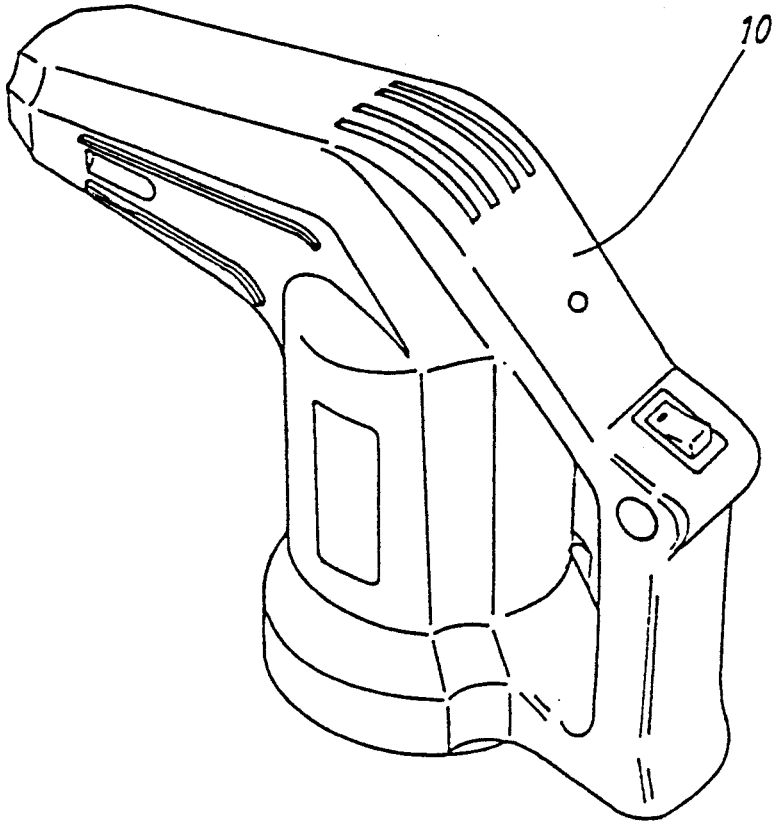
FIG. 1 is a perspective view showing a preferred embodiment of a portable car-used oil extracting and tire inflation apparatus according to the present invention.
Figure 2:
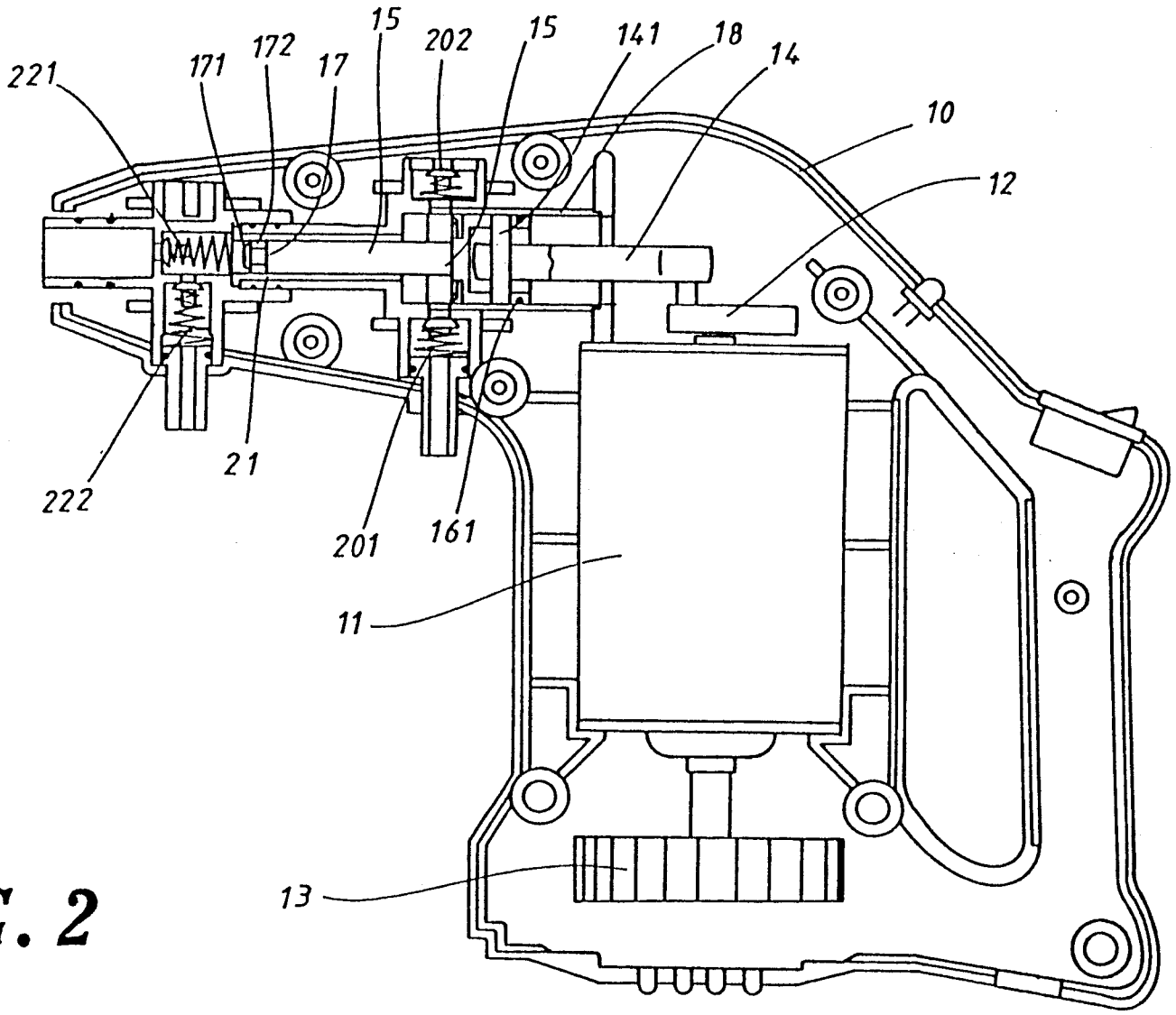
FIG. 2 is a side elevation of the preferred embodiment, partly in section.
Figure 3:
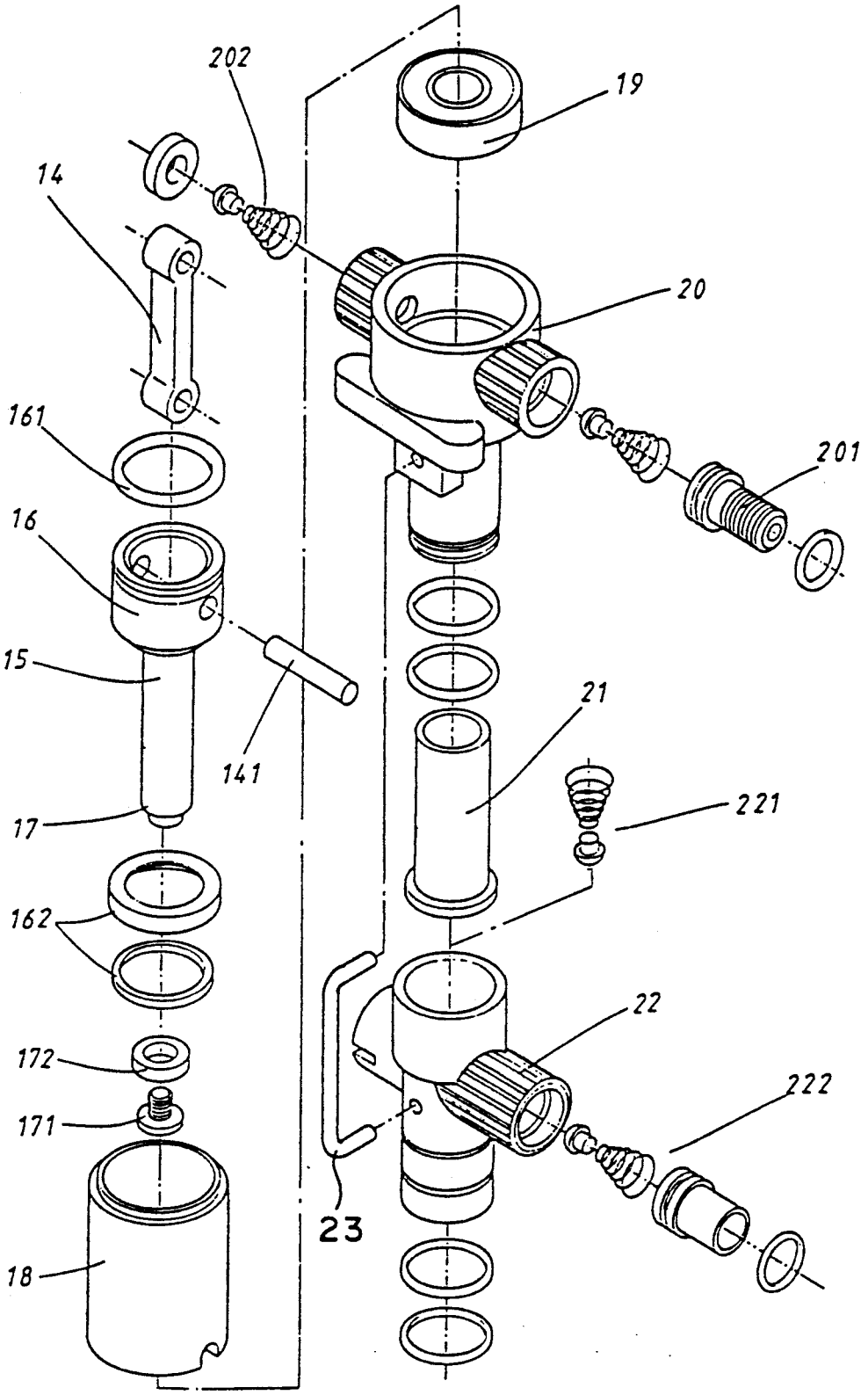
FIG. 3 is an exploded view of the embodiment, illustrating its construction.

Referring to FIGS. 1, 2, and 3, the illustrated apparatus chiefly comprises a casing 10 like a kettle in shape, and an electrical motor 11 on the shaft of which a fan 13 is pivotably mounted on the rear end to dissipate heat, and a crank shaft 12 on the front end, which crank shaft is connected to a rocker arm 14 by means of an insertion pin, on one end of which rocker arm is provided a connecting pin 141 to secure said rocker arm to the cylinder shaft 15 so that the motion of the rocker arm can drive said cylinder shaft to reciprocate. In addition, on the cylinder shaft 15, there are formed an air piston 16 on the rear end, and an oil piston 17 on the front end; around the outer periphery of which air piston are mounted an O-ring 161 and a retainer 162 with a brass gasket, and on the end surface of which oil piston a graphite ring 172 is fixed by a screw 171. With this arrangement, the combination forms the core portion of a single cylinder with dual pistons.

The cylinder jacket, mating with the cylinder shaft to generate pumping pressure, consists of an air cylinder jacket 18, an oil seal 19, an air pump body 20, an oil cylinder jacket 21, and an oil pump body 22 assembled in series, wherein the oil pump body 22 is installed in the front, comprising two uniflow valves 221, 222 inside; behind which pump body 22 is the oil cylinder jacket 21 of which the central hollow portion is connected to the oil chambers of said uniflow valves 221, 222; on the rear end of which oil cylinder jacket 21 is mounted the air pump body 20, also comprising two uniflow valves 201, 202 inside; on whose rear end the air cylinder jacket 18 is installed and the oil seal 19 is placed in said air pump body 20, between the air cylinder jacket 18 and the oil cylinder jacket 21, to separate the air chamber and the oil chamber. Moreover, an oil duct 23 leading to the oil inlet is provided on the oil pump to guide overflow oil so as to prevent oil leakage.

As the described above, the apparatus of this invention is designed to employ a motor to drive the shaft of the duplex cylinder by a crank shaft. On the crank shaft are mounted an air piston and an oil piston which mate with the pump structure attached to the air and the oil cylinder jackets, forming an air pump and an oil pump. Besides, the oil duct connecting the oil inlet can prevent oil leakage. The oil cylinder is made by a special powder metallurgy method and the piston is equipped with a graphite ring, which makes a long-time operation possible without the risk of piston binding. Hence, the apparatus is a device that can simultaneously perform scrap oil extracting and tire inflation and really a new and useful invention.

What is claimed is:

1. A portable car-used oil extracting and tire inflation apparatus, mainly comprising a casing, and an electrical motor outputing rotary power with a rotary shaft on the front end of which is pivoted a crank shaft by which the push rod with pistons is driven to perform reciprocating motion, forming an air pump and an oil pump; characterized in that on the push rod, there are mounted an air piston on the rear end, and a piston ring around the periphery of the front end, forming an oil piston; in that an air cylinder is installed behind an oil cylinder wherein two cylinders are separated by an oil seal arranged therebetween; and in that when the rotary motion of the motor shaft is converted into a reciprocating motion of the push rod, the air piston and the oil piston synchronously move, forming an air pump and an oil pump.

2. A portable car-used oil extracting and tire inflation apparatus as claimed in claim 1; wherein the casing is equipped with a handle to facilitate carrying.

3. A portable car-used oil extracting and tire inflation apparatus as claimed in claim 1; wherein the oil cylinder of the oil pump apparatus has a powdered metallurgy structure which provides an oily lubricating effect.

4. A portable car-used oil extracting and tire inflation apparatus as claimed in claim 1; wherein an oil duct connects the oil cylinder and the oil inlet to guide overflow oil returning to the inlet such that oil leakage can be avoided.

5. A portable car-used oil extracting and tire inflation apparatus as claimed in claim 1, in which the piston ring is a graphite ring.

* * * * *